US005611089A

United States Patent [19]

Cretors

[11] Patent Number: 5,611,089

[45] Date of Patent: Mar. 18, 1997

[54] APPARATUS FOR PROVIDING LIGHT TO A TOILET SEAT AND COVER

[76] Inventor: Kent J. Cretors, 1136 N. Detroit St., Xenia, Ohio 45385

[21] Appl. No.: 507,760

[22] Filed: Jul. 26, 1995

[51] Int. Cl.[6] ..... A47K 13/30

[52] U.S. Cl. ..... 4/234; 4/661

[58] Field of Search ..... 4/234, 237, 661, 4/902, DIG. 6; 362/101, 155, 184, 185, 234, 253

[56] References Cited

U.S. PATENT DOCUMENTS

| | | | |
|---|---|---|---|
| 3,982,288 | 9/1976 | Borne | 4/237 |
| 4,736,471 | 4/1988 | Johnson | 4/234 |
| 5,003,648 | 4/1991 | Anderson | 4/661 |
| 5,036,443 | 7/1991 | Humble et al. | 4/661 X |
| 5,263,209 | 11/1993 | Pattee | 4/661 |
| 5,276,595 | 1/1994 | Patrie | 4/661 X |

*Primary Examiner*—Charles E. Phillips
*Attorney, Agent, or Firm*—Michael I. Kroll

[57] ABSTRACT

A toilet lighting device is provided and consists of a illuminating unit within a toilet seat which will illuminate a toilet bowl, so that the toilet can be used in the dark. A radiating unit within a toilet seat cover can function as a night light when the toilet seat cover is placed in an upright position.

1 Claim, 1 Drawing Sheet

APPARATUS FOR PROVIDING LIGHT TO A TOILET SEAT AND COVER

BACKGROUND OF THE INVENTION

1. Field of the Invention

The instant invention relates generally to lamps and more specifically it relates to a toilet lighting device.

2. Description of the Prior Art

Numerous lamps have been provided in prior art that are adapted to produce light, which is radiation, so as to make vision possible. While these units may be suitable for the particular purpose to which they address, they would not be as suitable for the purposes of the present invention as heretofore described.

SUMMARY OF THE INVENTION

A primary object of the present invention is to provide a toilet lighting device that will overcome the shortcomings of the prior art devices.

Another object is to provide a toilet lighting device in which an illuminating unit within a transparent toilet seat, will illuminate a toilet bowl, so that the toilet can be used in the dark.

An additional object is to provide a toilet lighting device in which a radiating unit within a toilet seat cover can serve as a night light, when the toilet seat cover is placed in an upright position.

A further object is to provide a toilet lighting device that is simple and easy to use.

A still further object is to provide a toilet lighting device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
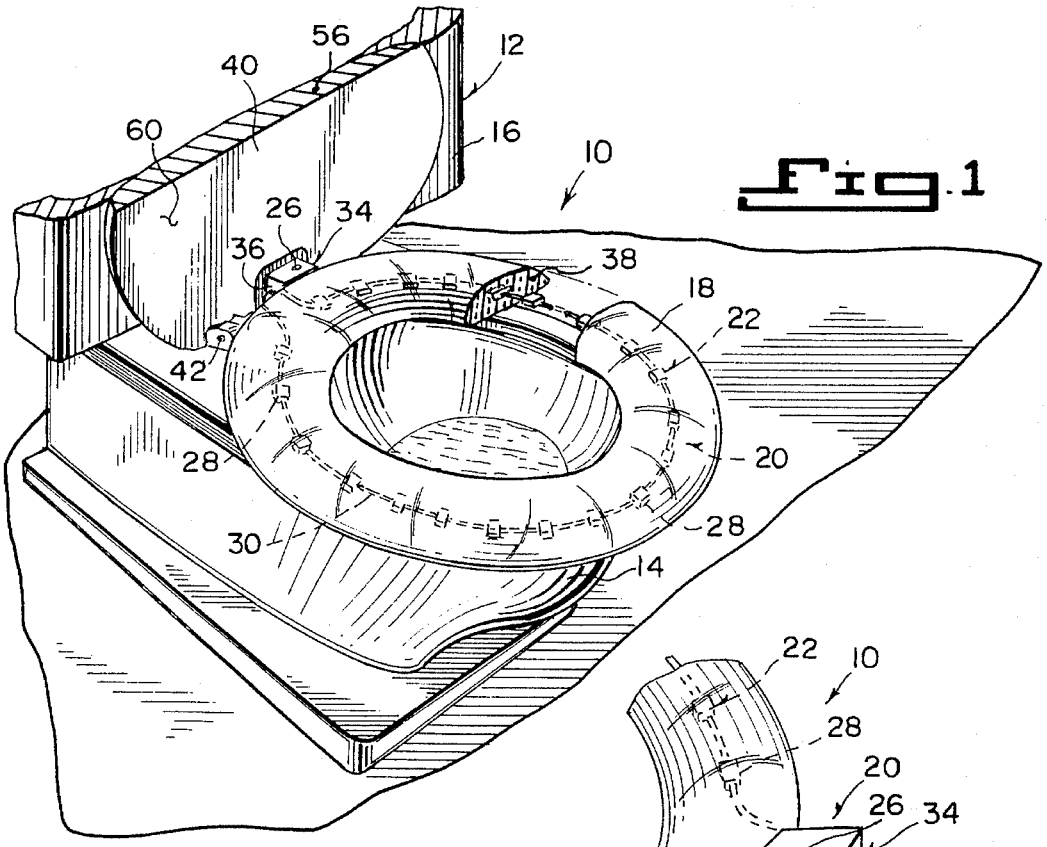
FIG. 1 is a front perspective view of a toilet with parts broken away, showing a transparent toilet seat with a first illuminating unit built therein.
Figure 2:
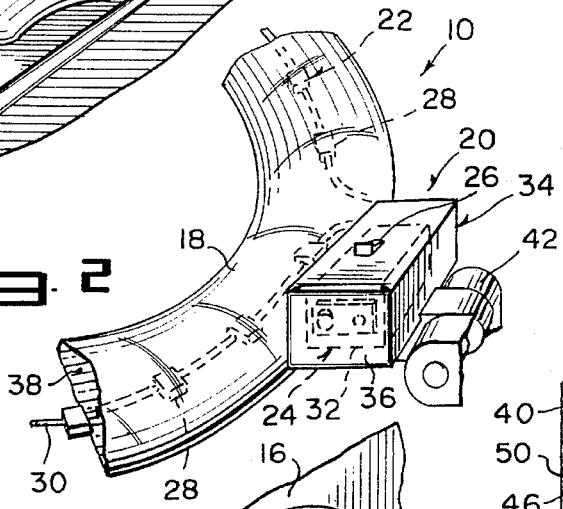
FIG. 2 is a rear perspective view of a portion of the toilet seat showing the power pack in greater detail.
Figure 3:
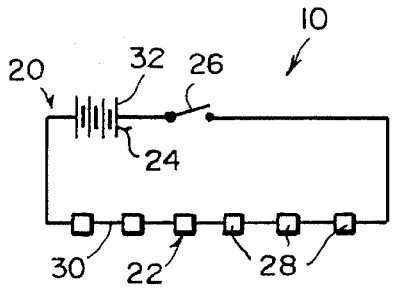
FIG. 3 is a schematic diagram of the electrical circuit of the first illuminating unit in FIGS. 1 and 2.

Turning now descriptively to the drawings, in which similar reference characters denote similar elements throughout the several views, FIGS. 1 through 3 illustrate a toilet lighting device 10 for a toilet 12 having a bowl 14 and tank 16, which comprises a toilet seat 18 mounted onto the bowl 14 of the toilet 12. A unit 20 is carried in the toilet seat 18, for illuminating the bowl 14, so that the toilet 12 can be seen and used in the dark.

The illuminating unit 20 includes a light source 22, to illuminate the bowl 14 of the toilet 12. A facility 24 is for supplying an electric current to the light source 22. A switch 26 is to turn the light source 22 on and off.

The light source 22 consists of a plurality of light emitting diodes 28 spaced apart and carried within the toilet seat 18. A wire 30 is carried within the toilet seat 18 and electrically connects the light emitting diodes 28 together in series. The electric current supplying facility 24 is a battery 32.

A power pack 34 which is a container 36 is carried at a back end of the toilet seat 18, for holding the battery 32 therein and the switch 26 thereon. The toilet seat 18 is fabricated out of a transparent material 38. The illuminating unit 20 will also light up the toilet seat 18, as well as the bowl 14 in the dark.

Figure 5:
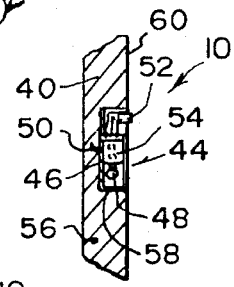
FIG. 5 is a cross sectional view taken along line 5—5 in FIG. 4, showing the internal structure of the toilet seat cover and the second illuminating unit.
Figure 4:
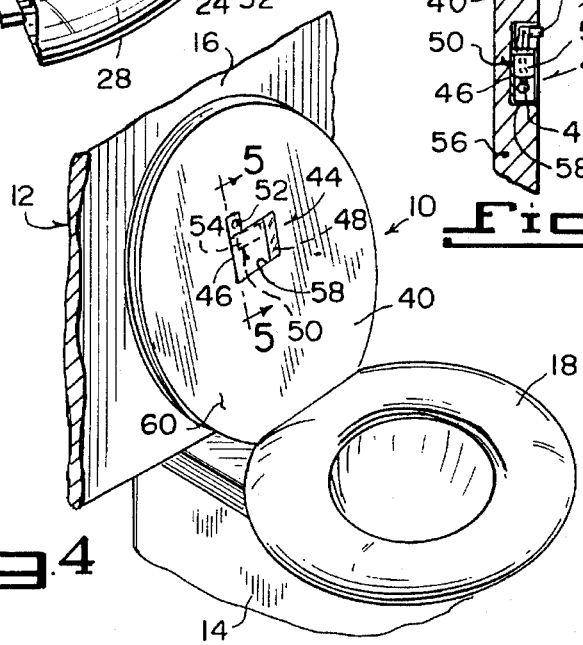
FIG. 4 is a front perspective view of a toilet with parts broken away, showing a toilet seat cover in an upright position with a second illuminating unit built therein.

The toilet lighting device 10, as best seen in FIGS. 4 and 5, further includes a toilet seat cover 40, rearwardly hinged at 42 to the toilet seat 18. A unit 44 carried in the toilet seat cover 40 for radiating light in an area about the toilet seat cover 40, when the toilet seat cover 40 is in an upright position against the tank 16, so that the unit radiating unit 44 can function as a night light.

The light radiating unit 44 contains a housing 46 carried within the toilet seat cover 40. A lamp 48 within the housing 44 provides illumination about the toilet seat cover 40. A facility 50 within the housing 46 is for furnishing an electric current to the lamp 48. A switch 52 on the housing 46 is for turning the lamp 46 on and off, when the toilet seat cover 40 is in the upright position against the tank 16.

The electric current furnishing facility 50 is a battery 54. The toilet seat cover 40 is fabricated out of a strong durable material 56 and has a recess 58 in its inner face 60, for retaining the light radiating unit 44 therein.

The switch 26 can be operated manually or automatically when the toilet seat cover 40 is raised to the upright position against the tank 16. The switch 52 can also be operated manually or automatically, when the toilet seat cover 40 is raised to the upright position against the tank 16.

The light source 22 can consist of a plurality of mini filament lights (not shown), instead of the light emitting diodes 28 and can be placed into indented areas under the toilet seat 18. The wire 70 will still electrically connect the mini filament lights together in series.

OPERATION OF THE INVENTION

To use the illuminating unit 20 of the toilet lighting device 10, the following steps should be taken:

1. Lift the toilet seat cover 40, so that it is in an upstanding position against the tank 16 of the toilet 12.
2. Press the switch 26 of the illuminating unit 20 in the power pack 34 to the on position.

3. Turn off the lights in the room in which the toilet 12 is located, since the light emitting diodes 28 in the toilet seat 18 will light up the bowl 14 and the transparent material 38 of the toilet seat 18 in the dark.

4. Operate the toilet 12 in its normal manner.

To use the light radiating unit 44 of the toilet lighting device 10, the following steps should be taken:

1. Lift the toilet seat cover 40, so that it is in an upstanding position against the tank 16 of the toilet 12.
2. Press the switch 55 of the light radiating unit 44 in the toilet seat cover 40 to the on position.
3. Leave the toilet seat cover 40 in the upstanding position with the switch 55 in the on position, so that the lamp 48 in the toilet seat cover will function as a night light in the dark room.

LIST OF REFERENCE NUMBERS

10 light device
12 toilet
14 bowl of 12
16 tank of 12
18 toilet seat of 10
20 illuminating unit of 10
22 light source of 20
24 electric current supplying facility of 20
26 switch of 20
28 light emitting diode of 22
30 wire of 22
32 battery for 24
34 power pack
36 container for 34
38 transparent material for 18
40 toilet seat cover of 10
42 hinge between 18 and 40
44 light radiating unit of 10
46 housing of 44
48 lamp of 44
50 electric current furnishing facility of 44
52 switch of 44
54 battery for 50
56 strong durable material for 40
58 recess in 40
60 inner face of 40

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A lighting device for a toilet bowl and tank unit, comprising:

a) a toilet seat having an annular configuration and being hinged at a rear portion thereof to the toilet bowl, said seat being constructed of transparent material;

b) a light source comprising a plurality of light emitting diodes spaced apart around said annular seat and embedded within said toilet seat and means carried embedded in said transparent toilet seat for electrically connecting said light emitting diodes together in series; said means connecting said diodes to a power pack, said power pack carried by said seat at a rear end thereof between said annular portion and the point at which said seat is hinged, for supplying electric current to said light source, said power pack including a manually accessible switch;

d) a toilet seat cover hinged at a rear end thereof to said toilet bowl, a recess formed in a surface of said toilet seat cover facing said seat, a housing mounted in said recess, said housing containing a lamp with a battery and a switch connected thereto for radiating light in an area about said toilet seat cover when said toilet seat cover is in an upright position against the tank, said radiating light functioning as a night light.

* * * * *